US006515566B1

(12) United States Patent
Toi et al.

(10) Patent No.: US 6,515,566 B1
(45) Date of Patent: Feb. 4, 2003

(54) ELECTRONIC COMPONENT HAVING WIRE

(75) Inventors: Takaomi Toi, Sabae (JP); Tetsuya Morinaga, Fukui (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 66 days.

(21) Appl. No.: 09/676,624

(22) Filed: Oct. 2, 2000

(30) Foreign Application Priority Data

Sep. 30, 1999 (JP) ..... 11-279077

(51) Int. Cl.[7] ..... H01F 27/29

(52) U.S. Cl. ..... 336/192; 336/83; 336/185; 336/192

(58) Field of Search ..... 336/192, 83, 185

(56) References Cited

U.S. PATENT DOCUMENTS 4,014,660 A * 3/1977 Schreiner et al. ..... 29/183.5
5,023,698 A * 6/1991 Kobayashi et al. ..... 357/67
6,144,280 A * 11/2000 Amada et al. ..... 336/192

* cited by examiner

*Primary Examiner*—Elvin Enad
*Assistant Examiner*—Jennifer A. Poker
(74) *Attorney, Agent, or Firm*—Keating & Bennett, LLP

(57) ABSTRACT

An electronic component is constructed to prevent Cu elution to a solder from a wire, and also prevents the wire from becoming thin and being broken. A chip coil includes electrodes provided at both ends of a core. The electrodes include an underlying metal layer (Ag), a Ni plated layer, and a Sn—Cu plated layer arranged in this sequence from the bottom thereof. Ends of a wire are embedded in the Sn—Cu plated layer of the electrodes by thermal compression bonding. When the chip coil is mounted on a land of a substrate by a reflow soldering, the Cu of the Sn—Cu plated layer is eluted into the reflow solder, and Cu elution from the wire is prevented

11 Claims, 3 Drawing Sheets

ELECTRONIC COMPONENT HAVING WIRE

BACKGROUND OF THE INVENTION

1. Field of the Invention

The present invention relates to an electronic component having wires, such as a wire wound type chip coil.

2. Description of the Related Art

Conventionally, a chip coil having stability at the time of mounting is disclosed in Unexamined Japanese Patent Publication 10-312922. In this chip coil, an electrode includes an underlying metal layer, an Ni-plated layer, and a Sn-plated layer. The end of the wire is embedded in the Sn-plated layer by thermal compression bonding.

In this kind of the chip coil, the Cu of the wire is melted and penetrates into the Sn in a molten solder and the Sn-plated layer at the time of mounting (reflow soldering), and the thickness of the wire is greatly reduced and becomes very thin. In some cases, the wire may be eluted and broken. Usually since the wire constituting a coil has an insulating coating film, if the insulating film has a high heat resistance, eluting of Cu can be avoided. However, since an end portion of the wire, at which the insulating film is removed, is connected to the electrode, the end portion of the wire without the insulating film is eluted into Sn in a molten solder and the Sn-plated layer. The recently required size reduction of an electronic component requires that the wire be thinner. Thus, it is necessary to prevent the wire from becoming thin and to prevent the wire breakage caused by the fact that Cu of the wire is eluted.

SUMMARY OF INVENTION

In order to overcome the problems described above, preferred embodiments of the present invention provide an electronic component that prevents Cu of a wire from eluting into Sn in molten solder, a Sn-plated layer or other layer from the wire.

According to one preferred embodiment of the present invention, an electronic component includes an insulating body having an electrode provided thereon, and a wire made of Cu wound on the insulating body, an end of the wire is fixed to the electrode, wherein the electrode includes a plurality of conductive layers, and at least one of the conductive layers prevents Cu from eluting out of the wire.

An eluting prevention layer (at least one of the conductive layers which prevents Cu from eluting out of the wire) decreases the dissolution rate or stops the dissolution itself with Cu of the wire, and Sn in the molten solder and the plating layer. A suitable material for the eluting prevention layer is Cu. The fact that one layer of the electrode includes Cu results in the state that Cu is eluted into Sn in advance, and Cu of the wire is prevented from eluting. Cu for preventing elution is preferably provided as an Sn—Cu alloy layer or a single Cu layer. Preferably a Cu content of Sn—Cu alloy layer is about 0.5–30 wt %. Generally, the temperature at the time of the soldering is about 240° C. to about 260° C. Regarding the eutectic concentration of Cu and Sn in this range of temperature, that of Cu is about 0.5 wt % to about 0.6 wt %. Accordingly, when the content of Cu is at least 0.5 wt %, elution of Cu is prevented beyond that content. When the content of Cu exceeds 3.0 wt %, solderability deteriorates. The inventors have discovered that Ni is a material which also prevents elution of Cu. The Cu elution preventing effect is sufficiently achieved by using a Sn—Ni alloy layer.

Other features, elements, characteristics and advantages of preferred embodiments of the present invention will become apparent from the following detailed description of preferred embodiments thereof with reference to the attached drawings.

DETAILED DESCRIPTION OF PREFERRED EMBODIMENTS

Preferred embodiments of the electronic component according to the present invention will be described in more detail with reference to the accompanying drawings.

Figure 1A:
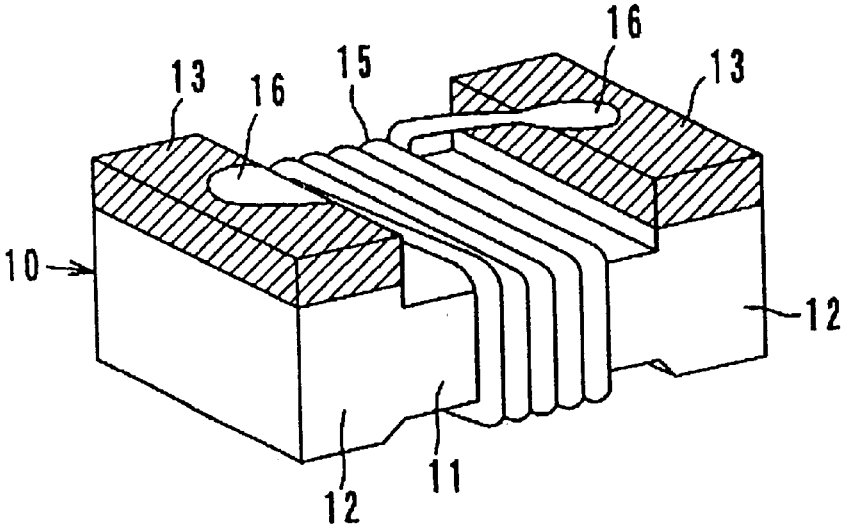
FIG. 1A is a perspective view showing a chip coil according to a first preferred embodiment of the present invention.
Figure 1B:
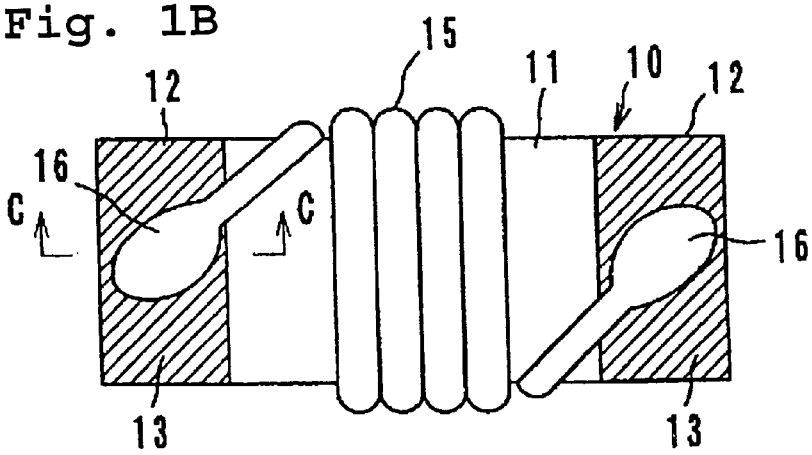
FIG. 1B is a plan view showing the chip coil according to the first preferred embodiment of the present invention.
Figure 1C:
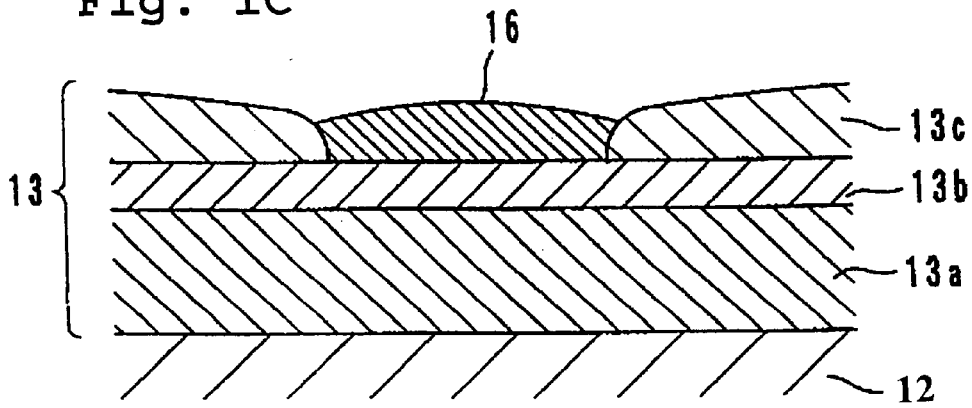
FIG. 1C is a cross-sectional view of the chip coil taken along a line C—C of FIG. 1B according to the first preferred embodiment of the present invention.

FIGS. 1A–1C show a chip coil of a first preferred embodiment of the present invention. In FIGS. 1A and 1B, the chip coil preferably includes a wire 15 made of Cu which is wound around a reel portion 11 of a core 10 made of an alumina or other suitable materials. Both ends 16 of the wire are fixed on respective electrodes 13 provided in projecting portions 12 provided at both ends of the core 10 by the thermal compression bonding.

As shown in FIG. 1C, which is a cross-sectional view taken along a line C—C of FIG. 1B, the electrode 13 preferably includes an underlying metal layer 13*a*, an Ni plated layer 13*b*, and a Sn—Cu plated layer 13*c* on the core 10 in this sequence from the bottom. The underlying metal layer 13*a* is formed on the core 10 by applying and sintering a paste made of Ag, Ag—Pd or other suitable materials. The thickness of the underlying metal layer 13*a* is preferably about 15 $\mu$m. The Ni plated layer 13*b* is provided on the underlying metal layer 13*a* to improve solder resistance and the thickness thereof is at least about 1 $\mu$m, preferably about 3 $\mu$m or greater. The Sn—Cu plated-layer 13*c* as a parent solder layer is provided on the Ni plated layer 13*b*, and includes Cu to function as a Cu eluting prevention layer which prevents Cu of the wire 15 from eluting. The thickness of the Sn—Cu plated-layer 13*c* is preferably about 14 μm in the present preferred embodiment. The content of Cu in the Sn—Cu plated-layer 13*c* is preferably about 0.5 wt % to about 30 wt %. The content ratio of Cu is preferably the eutectic concentration of at least Cu and Sn. The upper limit of the Cu content depends on a degree of solderability deterioration.

Figure 2A:
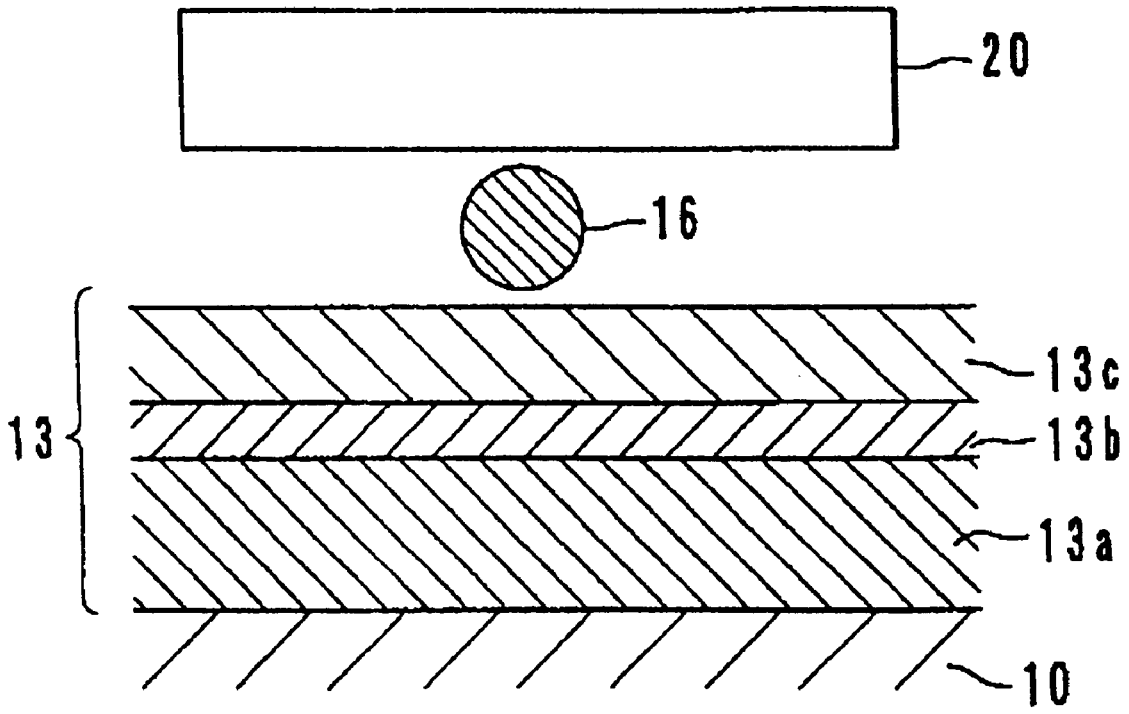
FIG. 2A is a cross-sectional view showing a state before thermal compression bonding is performed in the thermal compression bonding process in which ends of a wire are bonded with an electrode of the chip coil according to the first preferred embodiment of the present invention.
Figure 2B:
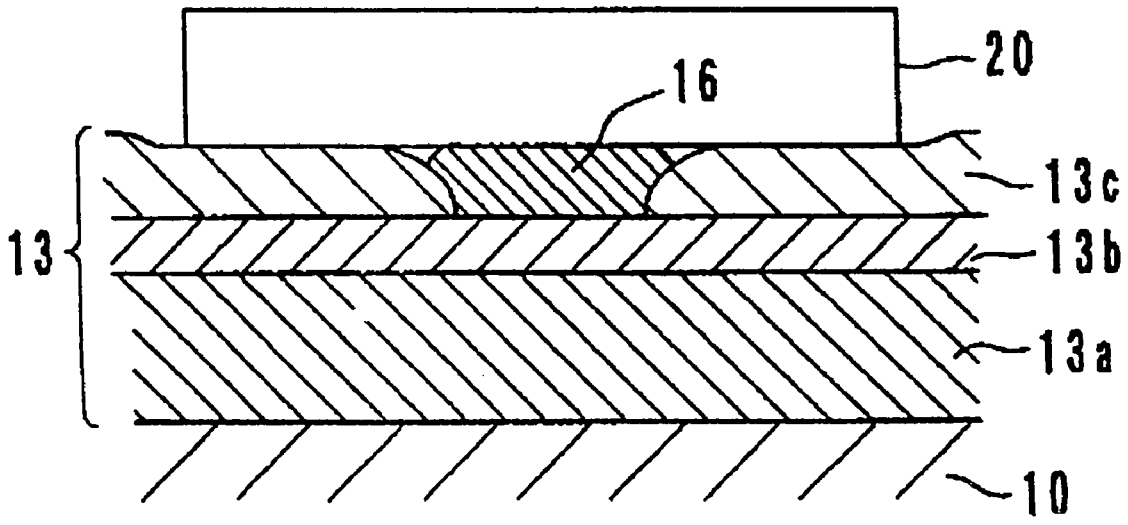
FIG. 2B is a cross-sectional view showing a state at the time when the thermal compression bonding is performed in the thermal compression bonding process in which ends of a wire are bonded with an electrode of the chip coil according to the first preferred embodiment of the present invention.

With reference to FIGS. 2A and 2B, the wire 15 preferably includes a conductor made of Cu and an insulating film provided on the conductor. The conductor preferably has a diameter of about 20 μm to about 60 μm. The insulating film is preferably made of polyesterimide or other suitable insulating materials. The ends 16 of the wire 15 are embedded in the Sn—Cu plated layers 13*c* of the electrodes 13 in a state where the insulating film of the wire is removed by the thermal compression bonding as shown in FIG. 2B. In detail, when the ends 16 are heated at 300° C. or greater with the load 10N or greater by a heater 20, the Sn—Cu plated layer 13*c* is melted and the ends 16 are embedded therein. Further, the insulating film of the wire is removed and the exposed Cu conductor is brazed and fixed to the Sn—Cu plated layer 13*c*.

With the above described configuration of the chip coil, the chip coil is mounted on a land of a substrate by reflow soldering, and Cu of the Sn—Cu plated layer 13*c* is eluted into the molten solder provided on the land. The rate at which Cu of the Sn—Cu plated-layer 13*c* is melted into the molten solder is much greater than a rate at which Cu of the wire 15 is melted into the molten solder. Accordingly, before the elution of Cu of the wire 15 begins, Cu contained in the molten solder on the land becomes rich due to the Cu of the Sn—Cu plated layer 13*c*. Thereby, Cu elution out of the wire 15 is prevented. This prevents the wire from becoming thin and from being broken.

In addition, when a Sn—Ni plated layer instead of the Sn—Cu plated layer 13*c* is provided, Cu elution out of the wire 15 can be prevented.

Figure 3A:
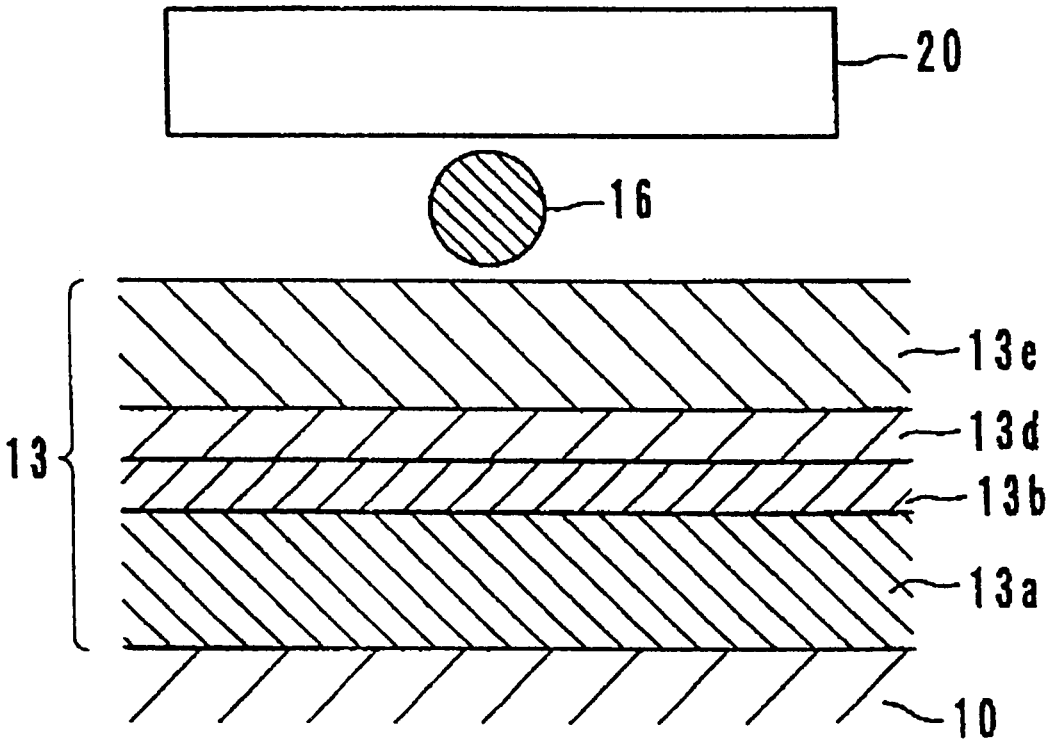
FIG. 3A is a cross-sectional view showing a state before thermal compression bonding is performed in the thermal compression bonding process in which ends of a wire are bonded with an electrode of the chip coil according to a second preferred embodiment of the present invention.
Figure 3B:
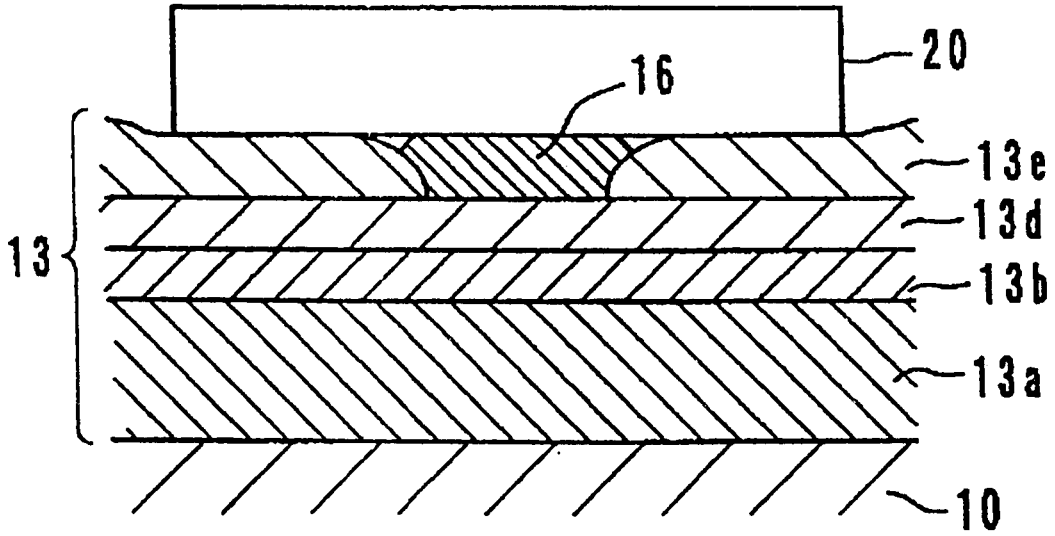
FIG. 3B is a cross-sectional view showing a state at the time when the thermal compression bonding is performed in the thermal compression bonding process in which ends of a wire are bonded with an electrode of the chip coil according to the second preferred embodiment of the present invention.

FIGS. 3A and 3B show only the electrode portion of the chip coil in the second preferred embodiment according to the present invention. The electrode 13 preferably includes an underlying metal layer 13*a*, a Ni plated layer 13*b*, a Cu plated layer 13*d* and a Sn plated layer 13*e* on the core 10 in this sequence from the bottom thereof. The underlying metal layer 13*a* and the Ni plated-layer 13*b* are preferably similar to that described in the first preferred embodiment. The Cu plated layer 13*d* is provided on the Ni plated-layer 13*b* and functions as a Cu eluting prevention layer of the wire 15, and the thickness thereof is at least about 2 μm. At the end of thermal compression boding process, it is preferable that the Cu plated layer 13*d* having a thickness of at least about 1 μm remains. This is because when the thickness of the Cu plated layer 13*d* is less than about 1 μm, the necessary amount of Cu is reduced and the Cu eluting prevention layer does not sufficiently prevent eluting. The Sn plated layer 13*e* defining a parent solder layer is provided on the Cu plated layer 13*d* and preferably has a thickness of about 14 μm.

The ends 16 of the wire 15 are bonded with the electrodes 13 with the heater 20 by the thermal compression boding as is similar to first preferred embodiment. The ends of the wire 15 are embedded in the Sn plated layer 13*e*, the insulating film of the wire 15 is removed, and the ends of the wire are brazed and fixed to the Sn plated layer 13*e*. Further, the ends of the wire 15 are also compression-bonded with the Cu plated layer 13*d*.

When the chip coil of the second preferred embodiment is mounted on the land of the substrate by reflow soldering, the Cu plated layer 13*d* contacts with a molten solder after the Sn plated layer 13*e* is melted into the molten solder on the land. By the heat of the reflow soldering process, the Cu plated layer 13*d* begins to be melted into the molten solder on the land, Cu contained in the molten solder becomes rich gradually. Since a surface area of the exposed ends 16 of the wire 15 is much smaller that that of the Cu plated layer 13*d*, the amount in which Cu of the Cu plated layer 13*d* is melted into Sn of the molten solder is overwhelmingly greater than the amount in which Cu of the wire 15 is melted into Sn of the molten solder. In other words, before the elution of Cu of the wire 15 progresses, Cu contained in the molten solder on the land becomes rich since Cu is melted into the molten solder from the Cu plated layer 13*d*. Thereby, Cu elution out of the wire 15 is prevented. This prevents the wire from becoming thin and from being broken.

Further, as described in the second preferred embodiment, when the ends 16 of the wire 15 are bonded with the electrodes 13 by thermal compression bonding, heat at the time of the thermal compression bonding process causes the Sn plated layer 13*e* and the Cu plated layer 13*d* to be partially melted, then become a Sn—Cu alloy layer at the end of the process. In order to obtain the Sn—Cu alloy layer, it is preferable that the ends of the wire are bonded by thermal compression boding after forming the Cu plated layer having a thickness of about 4 μm to about 5 μm, which is slightly thicker than the above described Cu plated layer in the second preferred embodiment. In this case, the effect described in the first preferred embodiment also can be achieved.

The electronic component according to the present invention is not limited to the above-described preferred embodiments. Various applications and modifications are contemplated and within the scope of the present invention The present invention is broadly applicable to a wire wound inductor and to a composite electronic component that combines a wire wound inductor and other electronic elements, such as a capacitor, other than the chip inductor. The insulating body includes not only the magnetic core 10 but also may include a ceramic body. Further, the lamination configuration of the electrodes 13, the dimension of the thickness, and the materials described in the first and second preferred embodiments are merely examples of the present invention. The configurations, dimensions, materials and other characteristics may be modified to satisfy the required specification of an electronic component.

As is clear from the above description, according to the present invention, at least one of the conductor layers constituting an electrode prevents Cu out of the wire from eluting into Sn in the molten solder of reflow soldering at the time of mounting the electronic component. Thereby, Cu elution out of the wire is prevented. This prevents the wire from becoming thin and being broken.

It should be understood that the foregoing description is only illustrative of preferred embodiments of the present invention. Various alternatives and modifications can be devised by those skilled in the art without departing from the present invention. Accordingly, the present invention is intended to embrace all such alternatives, modifications and variations that fall within the scope of the appended claims.

What is claimed is:

1. An electronic component comprising:

an insulating body including an electrode provided thereon; and a wire made of Cu beign wound on the insulating body, an end of said wire being fixed to said electrode;

wherein said electrode includes a plurality of conductive layers, and at least one of the conductive layers prevents Cu from eluting out of said wire; and said plurality of conductive layer of said electrode includes an underlying metal layer, a Ni-plated layer, and one of a Sn—Cu plated layer, a Sn—Ni plated layer and a Sn-plated layer, arranged in sequence from the bottom thereof.

2. An electronic component according to claim 1, wherein said eluting prevention layer is a Sn—Cu alloy layer.

3. An electronic component according to claim 2, wherein a Cu content of said Sn—Cu alloy layer is about 0.5 wt % to about 30 wt %.

4. An electronic component according to claim 1, wherein said eluting prevention layer is a Sn—Ni alloy layer.

5. An electronic component according to claim 1, wherein said eluting prevention layer is a Cu layer.

6. An electronic component comprising:

an insulating body including an electrode provided thereon; and a wire made of Cu being wound on the insulating body, an end of said wire being fixed to said electrode;

wherein said electrode is arranged to prevent Cu from eluting out of said wire; and said electrode includes an underlying metal layer, a Ni-plated layer, and one of a Sn—Cu plated layer, a Sn—Ni plated layer and a Sn-plated layer, arranged in sequence from the bottom thereof.

7. An electronic component according to claim 6, wherein said electrode includes a plurality of conductive layers, and at least one of the conductive layers prevents Cu from eluting out of said wire.

8. An electronic component according to claim 7, wherein said eluting prevention layer is a Sn—Cu alloy layer.

9. An electronic component according to claim 8, wherein a Cu content of said Sn—Cu alloy layer is about 0.5 wt % to about 30 wt %.

10. An electronic component according to claim 7, wherein said eluting prevention layer is a Sn—Ni alloy layer.

11. An electronic component according to claim 7, wherein said eluting prevention layer is a Cu layer.

* * * * *